US007682241B2

(12) United States Patent
Baerlocher

(10) Patent No.: US 7,682,241 B2
(45) **Date of Patent: *Mar. 23, 2010**

(54) GAMING DEVICE HAVING FREE GAME KENO

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 209 days.

This patent is subject to a terminal disclaimer.

(21) Appl. No.: 11/951,830

(22) Filed: Dec. 6, 2007

(65) Prior Publication Data

US 2008/0090634 A1 Apr. 17, 2008

Related U.S. Application Data

(63) Continuation of application No. 10/243,051, filed on Sep. 12, 2002, now Pat. No. 7,306,519.

(51) Int. Cl.
*A63F 9/24* (2006.01)

(52) U.S. Cl. ..... 463/18; 273/269

(58) Field of Classification Search ..... 463/18–19, 463/25–28; 273/269, 292
See application file for complete search history.

(56) References Cited

U.S. PATENT DOCUMENTS

| | | | |
|---|---|---|---|
| 4,033,588 | A | 7/1977 | Watts |
| 4,775,155 | A | 10/1988 | Lees |
| 5,046,737 | A | 9/1991 | Fienberg |
| 5,100,139 | A | 3/1992 | Di Bella |
| 5,116,049 | A | 5/1992 | Sludikoff et al. |
| 5,158,293 | A | 10/1992 | Mullins |
| 5,242,163 | A | 9/1993 | Fulton |
| 5,401,024 | A | 3/1995 | Simunek |
| 5,586,937 | A | 12/1996 | Menashe |
| 5,628,684 | A | 5/1997 | Bouedec |
| 5,639,089 | A | 6/1997 | Matsumoto et al. |
| 5,647,798 | A | 7/1997 | Falciglia |

(Continued)

FOREIGN PATENT DOCUMENTS

| | | |
|---|---|---|
| GB | 2 374 294 | 10/2002 |

(Continued)

OTHER PUBLICATIONS

Alley Cat Keno Game Description, written by IGT, available prior to Sep. 12, 2002.

(Continued)

*Primary Examiner*—Peter DungBa Vo
*Assistant Examiner*—Alex P. Rada
(74) *Attorney, Agent, or Firm*—K&L Gates LLP

(57) ABSTRACT

The present invention provides an improved Keno game, which provides an opportunity for the player to win free games. In Keno, the player chooses an amount of numbers to play, usually one to fifteen, and plays against the house. The game or house randomly generates numbers, usually twenty numbers from the numbers one to eighty. The number of matches generated and the amount of numbers the player plays determines whether and how much the player wins. One or more of the random generations is also a free game generation in the present invention, which provides one or more free Keno games to the player if the free game generation results in a match.

33 Claims, 5 Drawing Sheets

U.S. PATENT DOCUMENTS

| | | | |
|---|---|---|---|
| 5,674,128 | A | 10/1997 | Holch et al. |
| 5,718,631 | A | 2/1998 | Invencion |
| 5,755,619 | A | 5/1998 | Matsumoto et al. |
| 5,779,545 | A | 7/1998 | Berg et al. |
| 5,800,269 | A | 9/1998 | Holch et al. |
| 5,871,398 | A | 2/1999 | Schneier et al. |
| 5,909,875 | A | 6/1999 | Weingardt |
| 5,935,002 | A | 8/1999 | Falciglia |
| 5,944,606 | A | 8/1999 | Gerow |
| 5,949,042 | A | 9/1999 | Dietz, II et al. |
| 5,954,582 | A | 9/1999 | Zach |
| 5,970,143 | A | 10/1999 | Schneier et al. |
| 5,971,849 | A | 10/1999 | Falciglia |
| 6,017,032 | A | 1/2000 | Grippo et al. |
| 6,024,640 | A | 2/2000 | Walker et al. |
| 6,033,306 | A | 3/2000 | DeSouza |
| 6,079,711 | A | 6/2000 | Wei et al. |
| 6,089,976 | A | 7/2000 | Schneider et al. |
| 6,089,982 | A | 7/2000 | Holch et al. |
| 6,099,408 | A | 8/2000 | Schneir et al. |
| 6,102,400 | A | 8/2000 | Scott et al. |
| 6,117,009 | A | 9/2000 | Yoseloff |
| 6,129,632 | A | 10/2000 | Luciano |
| 6,135,884 | A | 10/2000 | Hedrick et al. |
| 6,146,272 | A | 11/2000 | Walker et al. |
| 6,168,521 | B1 | 1/2001 | Luciano et al. |
| 6,183,361 | B1 | 2/2001 | Cummings et al. |
| 6,203,428 | B1 | 3/2001 | Giobbi et al. |
| 6,210,275 | B1 | 4/2001 | Olsen |
| 6,210,276 | B1 | 4/2001 | Mullins |
| 6,210,279 | B1 | 4/2001 | Dickinson |
| 6,217,448 | B1 | 4/2001 | Olsen |
| 6,220,961 | B1 | 4/2001 | Keane et al. |
| 6,241,606 | B1 | 6/2001 | Riendeau et al. |
| 6,250,685 | B1 | 6/2001 | Walker et al. |
| 6,254,480 | B1 | 7/2001 | Zach |
| 6,261,177 | B1 | 7/2001 | Bennett |
| 6,273,820 | B1 | 8/2001 | Haste, III |
| 6,280,328 | B1 | 8/2001 | Holch et al. |
| 6,283,855 | B1 | 9/2001 | Bingham |
| 6,309,298 | B1 | 10/2001 | Gerow |
| 6,315,291 | B1 | 11/2001 | Moody |
| 6,325,716 | B1 | 12/2001 | Walker et al. |
| 6,336,862 | B1 | 1/2002 | Byrne |
| 6,358,151 | B1 | 3/2002 | Enzminger et al. |
| 6,364,313 | B1 | 4/2002 | Moody |
| 6,368,213 | B1 | 4/2002 | McNabola |
| 6,368,214 | B1 | 4/2002 | Luciano |
| 6,368,218 | B2 | 4/2002 | Angell, Jr. |
| 6,398,644 | B1 | 6/2002 | Perrie et al. |
| 6,398,645 | B1 | 6/2002 | Yoseloff |
| 6,402,614 | B1 | 6/2002 | Schneier et al. |
| 6,419,583 | B1 | 7/2002 | Crumby et al. |
| 6,425,823 | B1 | 7/2002 | Byrne |
| 6,443,452 | B1 | 9/2002 | Brune |
| 6,443,837 | B1 | 9/2002 | Jaffe et al. |
| 6,450,885 | B2 | 9/2002 | Schneier et al. |
| 6,454,648 | B1 | 9/2002 | Kelly et al. |
| RE37,885 | E | 10/2002 | Acres et al. |
| 6,464,582 | B1 | 10/2002 | Baerlocher et al. |
| 6,475,086 | B2 | 11/2002 | Zach |
| 6,478,677 | B1 | 11/2002 | Moody |
| 6,508,711 | B1 | 1/2003 | Ono |
| 6,514,144 | B2 | 2/2003 | Riendeau et al. |
| 6,524,184 | B1 | 2/2003 | Lind et al. |
| 6,527,638 | B1 | 3/2003 | Walker et al. |
| 6,533,660 | B2 | 3/2003 | Seelig et al. |
| 6,533,664 | B1 | 3/2003 | Crumby |
| 6,537,150 | B1 | 3/2003 | Luciano et al. |
| 6,645,071 | B2 | 11/2003 | Perrie et al. |
| 6,656,044 | B1 | 12/2003 | Lewis |
| 6,695,699 | B2 | 2/2004 | Beauileu |
| 6,702,699 | B2 | 3/2004 | Touhey et al. |
| 6,729,961 | B1 | 5/2004 | Millerschone |
| 6,739,970 | B2 | 5/2004 | Luciano |
| 6,749,500 | B1 | 6/2004 | Nelson et al. |
| 6,764,397 | B1 | 7/2004 | Robb |
| 6,824,465 | B2 | 11/2004 | Luciano, Jr. |
| 6,855,055 | B2 | 2/2005 | Perrie et al. |
| 2002/0010013 | A1 | 1/2002 | Walker et al. |
| 2002/0058545 | A1 | 5/2002 | Luciano |
| 2002/0072404 | A1 | 6/2002 | Gerow |
| 2002/0082070 | A1 | 6/2002 | Macke et al. |
| 2002/0098882 | A1 | 7/2002 | Lind et al. |
| 2002/0098883 | A1 | 7/2002 | Packes, Jr. et al. |
| 2002/0111214 | A1 | 8/2002 | Lind et al. |
| 2002/0113369 | A1 | 8/2002 | Weingardt |
| 2002/0169018 | A1 | 11/2002 | Schneier et al. |
| 2003/0181234 | A1 | 9/2003 | Falciglia, Sr. |
| 2003/0193136 | A1 | 10/2003 | Walker et al. |
| 2004/0106445 | A1 | 6/2004 | Perrie et al. |
| 2005/0014553 | A1 | 1/2005 | Byrne |
| 2005/0227753 | A1 | 10/2005 | Luciano, Jr. |

FOREIGN PATENT DOCUMENTS

| | | |
|---|---|---|
| WO | WO 98/35309 | 8/1998 |

OTHER PUBLICATIONS

Big Top Keno Advertisement, written by Aristocrat, published Oct. 2000.
Bingo Advertisement, written by Casino Data Systems, published 1998.
Bingo Advertisement, written by WMS Gaming, Inc., published prior to 2003.
Bingo Ball Bingo Advertisement, written by BCSI Corporation, published prior to 2003.
Bingo Brasil Advertisement, written by Unidesa Gaming, published prior to 2003.
Bingo Game Station Advertisement, written by Cole Gaming Technologies, published prior to 2003.
Bingo Party Advertisement, written by Amatic Industries, published 2001.
Bingo Slot Advertisement, written by Unidesa Gaming, published prior to 2003.
Bingo Slots Advertisement, written by Odds on Gaming, published prior to 2003.
Bingo Wizard Advertisement, written by Applied Concepts, published 2002.
Bonus Bingo Advertisement, written by Unidesa Gaming, published prior to 2003.
California Dreams Advertisement, written by Cadillac Jack, published prior to 2003.
Canadian Bingo Advertisement, written by Unidesa Gaming, published prior to 2003.
Cash Keno Paytable, written by IGT, available prior to 2003.
Cleopatra Bingo Advertisement, written by IGT, published in 2000 and 2004.
Diamonopoly Advertisement, written by International Gamco, Inc., published 2002.
Dual Screen Keno Machine Picture Advertisement, written by Acres Gaming, Inc., published prior to 2003.
Electronic Pull Tabs Advertisement, written by 21st Century Gaming, published prior to 2002.
Five Card Instant Bingo Advertisement, written by IGT, published 2000.
Flamingo Reno-Keno, published prior to 2003.
Four Card Keno Game Screen Advertisement, written by IGT, published prior to 2001.
Free Game Keno, written by Keno-Info.com (website: www.keno-info.com/free_keno_game.html), website published 2002, printed on Aug. 11, 2002.
Gold Touch Multi-Game Advertisement, written by Cadillac Jack, published prior to 2003.

Instant Bingo Video Slots Advertisement, written by IGT, published 2002.
Instant Winner Advertisement, written by Williams/WMS Gaming, published prior to 2002.
Keno Advertisement, written by Cyberdyne Gaming, published prior to 2003.
Keno Advertisement, written by Odds on Gaming, published prior to 2003.
Keno Advertisement, written by WMS Gaming, Inc., published prior to 2003.
Krazy Keno Advertisement, written by Silicon Gaming, published prior to 2001.
Krazy Keno/Star Spangled Keno Advertisement, written by Silicon Gaming, published 2001.
Lucky Times California Lottery Newsletter, published 1996.
Party Time Bingo Advertisement, written by Astra Games Limited, published prior to 2003.
Play it Again Advertisement, written by International Gamco, Inc., published 2000.
Pot 0' Gold Advertisement, written by Vision Gaming & Technology, published prior to 2003.
Reel Bingo Advertisement, written by B Soft, published prior to 2003.
Slingo Games, written by Slingo.com Slingo Games (website: www.slingo.com/games/online/game.php), printed on Apr. 25, 2003.
Southern Gold Advertisement, written by Cadillac Jack, published prior to 2003.
Star Spangled Keno, Advertisement, written by Silicon Gaming, published 2001.
Triple Diamond Keno Paytable, written by IGT, available prior to 2003.
Ultimate Keno Advertisement, written by Bally Gaming Systems, published 2000.

GAMING DEVICE HAVING FREE GAME KENO

PRIORITY CLAIM

This application is a continuation application of U.S. patent application Ser. No. 10/243,051, filed on Sep. 12, 2002, entitled "Gaming Device Having Free Game Keno," the entire contents of which are incorporated herein by reference.

CROSS REFERENCE TO RELATED APPLICATIONS

This application relates to the following co-pending, commonly owned applications: "GAMING DEVICE HAVING GAME WITH SEQUENTIAL DISPLAY OF NUMBERS," Ser. No. 10/639,715, "CENTRAL DETERMINATION SYSTEM WITH A KENO GAME," Ser. No. 10/601,482, "GAMING DEVICE HAVING MATCHING GAME WITH IMPROVED DISPLAY," Ser. No. 10/953,430, and "GAMING DEVICE HAVING A WAGERING GAME WHEREIN A WAGER AMOUNT IS AUTOMATICALLY DETERMINED BASED ON A QUANTITY OF PLAYER SELECTIONS," Ser. No. 11/011,810.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates to gaming devices. More particularly, the present invention relates to the game of Keno.

Keno in the U.S. traces back to a game brought to the United States by Chinese immigrants in the 1800's. The Chinese game used a board and a set of up to one hundred twenty characters instead of numbers. Early versions of American Keno used characters on the Keno ticket, rather than the numbers used today. The American game dropped the number of characters to the more familiar eighty.

When gambling was legalized in the state of Nevada in 1931, the 'Chinese lottery' game was referred to instead as Horse Race Keno, referring to the idea that the numbers are horses and the player wants the wagered horse to come in. Later, the name was shortened to simply Keno, although the game is stilled referred to often as Horse Race Keno.

Keno is similar to a lottery game. The goal, like a lottery, is to choose a winning number or numbers from a plurality of numbers. In most versions of Keno, the player receives a card with eighty squares numbered one to eighty, arranged in rows of ten. The player can bet on any number or numbers, up to fifteen numbers, which the player does by marking selected numbers on a Keno card. A clerk records the player's bet(s), wherein the player pays for each number played or wagered.

The Keno numbers also appear on eighty ping pong type balls, which can be tossed about in a clear plastic sphere or spun around in a wire bird cage. Keno numbers were at one time drawn using a manually powered Keno goose. Later, a number of different lottery styles were used. Today, computers using random number generators generate the Keno numbers. When a number is chosen, the number is shown electronically on Keno boards throughout the casino.

A number of Keno outlets and Keno monitors are typically placed in various places around a casino or gaming establishment. In certain types of Keno, the player must return a winning ticket to the Keno ticket writer before the next game starts (usually about five minutes) or forfeit the win. Other types of Keno allow the player additional time.

Many casinos offer 'multi-race' cards, which allow the player to play the same set of numbers over multiple games. One type of 'multi' game allows the player to wager a single set of numbers over as many as twenty games. When finished, the player must return to the Keno station and cash in any wins. 'Stray and play' tickets are also available, which allow the player to play a version of Keno called 'walk away Keno'. Here, players can purchase a Keno ticket for an extended number of games, enjoy other activities in the casino and return at a later time or even a later date to have the tickets checked by a computer for winning games.

Another option for Keno players is a combination or 'way' ticket. A combination ticket enables the player to group different numbers, wherein each group has the same amount numbers, creating more than one way to win. For example, a 3×3×3, nine spot ticket allows the player to select a combination of three groups of three numbers. The player can, for example, mark a first group of three numbers with the letter "A," mark a second group with the letter "B" and mark a third group the letter "C". This ticket enables the player to win on any winning combination of three numbers for any of the three groups. Hitting any winning combination pays as though a single ticket had been played. Essentially, the player plays three games on one card. In some Keno games, playing three numbers in three games enables the player to play, or provides to the player an additional nine spot game.

The 'way' ticket supposedly makes Keno more exciting, enabling players to wager more money on more numbers. In reality, playing a way or combination ticket offers no mathematical advantage, and no disadvantage, to the player. Some casinos offer discounted minimum bets with 'way' tickets. If the player plays three or more ways, many casinos will discount the price per 'way' (e.g., let the player bet $0.50 per wager instead of a usual $1 minimum). The casino however only pays back on the player's actual bet.

Known variations on Keno do not affect the mathematics, payout or expected return of the game. It does not mathematically matter how many numbers the player chooses or if the player combines wagers. The player can choose less numbers if the player likes to win a smaller amount but a little more often. The player can choose more numbers if the player does not care about the frequency of the wins but wants bigger payouts.

Keno variations have not taken the form of a bonus, which could actually impact the player's expected return. One reason for this may be that Keno is perceived as sort of a side game that can be played and enjoyed while the player performs other activities, such as playing another game, eating or perusing the casino. Providing bonuses or bonus variations to existing games has increased popularity in other gaming areas, such as slot. Such a variation could also therefore increase the popularity and overall excitement in Keno.

SUMMARY OF THE INVENTION

The present invention provides an improved Keno game and gaming device, which each include an opportunity for the player to win free games. In Keno, the player chooses an amount of numbers to play, usually one to ten in the video game version or one to fifteen in the casino version when the player plays against the house. The gaming device or the house randomly and sequentially generates numbers, usually twenty numbers from the numbers one to eighty. The number of matches generated and the amount of numbers the player plays determines whether and how much the player wins. In the present invention, one or more of the random generations is also a free game generation, which provides one or more free Keno games to the player if it results in a match.

The free game in one embodiment is played the same as the game from which it was generated. That is, the same numbers are played. In another embodiment, a default set or a randomly generated set of numbers is played. The present invention incorporates the various multi-game Keno options available to the player, wherein one or more of the individual games on a multi game ticket can produce one or more free games for the player. The free games can be played immediately or after completing the multiple games. When multiple free games are provided, the gaming device or the random generation device of the house generates a new set of numbers for each free game. Additionally or alternatively, the player selects new numbers in each free game.

In one embodiment, the last number generated by the gaming device or the casino's random generation device is also the free game generation. In another embodiment, the Keno game employs multiple free game generations. In a further embodiment, the Keno game randomly determines when, if ever, to provide a free game generation. In yet another embodiment, a free game is provided only after a plurality of free game generations and matches. In any of these variations, a free game generation can result in one or more free games.

As mentioned above, Keno is a popular video game in gambling venues. The assignee of the present invention makes a number of Keno video wagering games that operate independently or that operate with other types of games. The Keno gaming device of the present invention in one embodiment includes the game of Keno. The free game Keno of the present invention is also operable in a single cabinet with the games of blackjack, craps, slot, poker or any other suitable wagering game, wherein an outcome in the Keno game can be used in the other primary game and vice versa In either case, the gaming device can be controlled: (i) by a processor provided therein; (ii) over a local area network in the gaming establishment; or (iii) over another type of data network such as the internet.

Additional features and advantages of the present invention are described in, and will be apparent from, the following Detailed Description of the Invention and the figures.

DETAILED DESCRIPTION OF THE INVENTION

Figure 1:
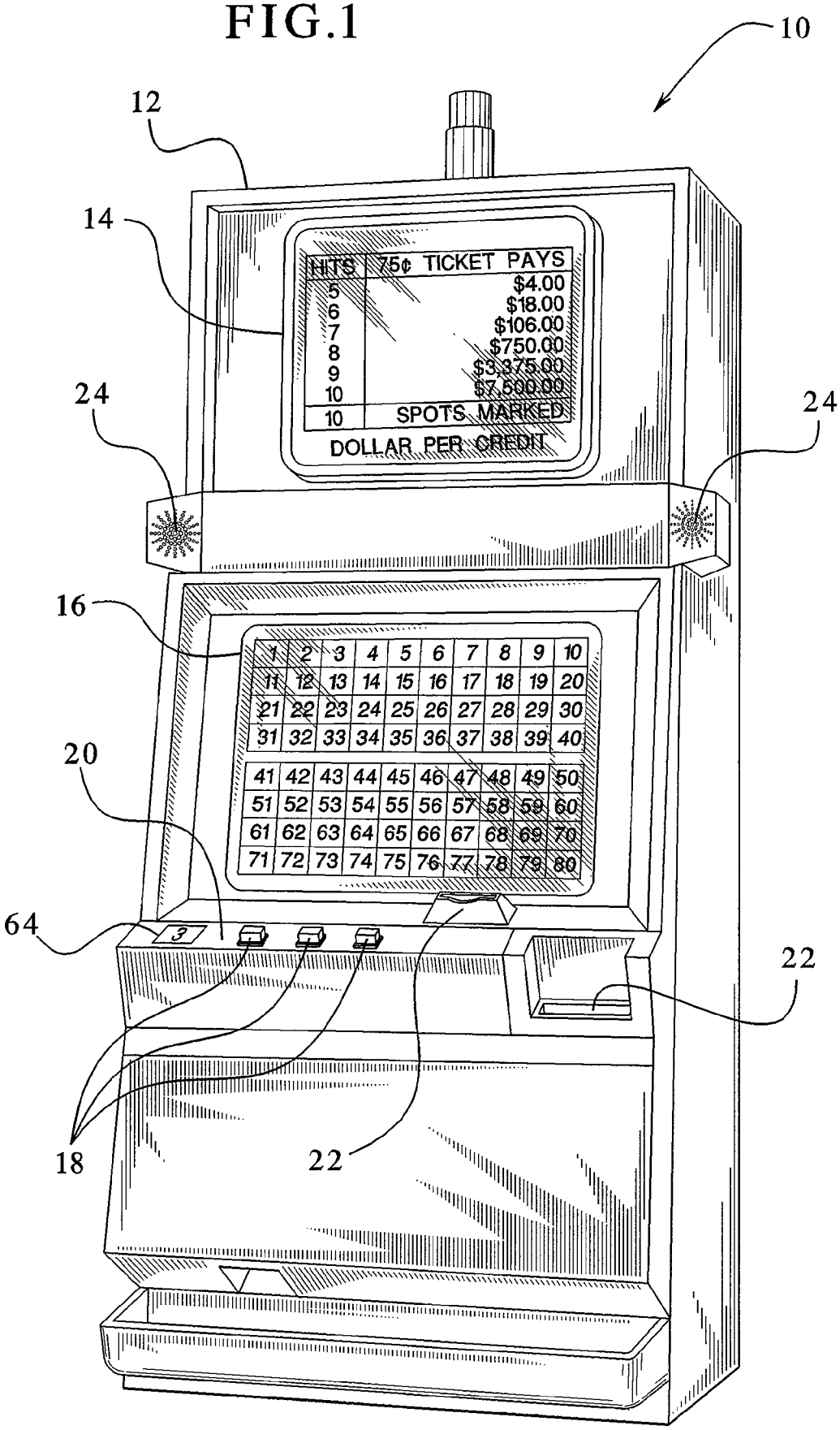
FIG. 1 is a perspective view of a gaming device incorporating the Keno game of the present invention.

Referring now to FIG. 1, each of the embodiments described herein is provided in one preferred embodiment in a gaming device 10. Alternatively, the embodiments are provided on various monitors throughout a casino or gaming establishment. Gaming device 10 is in one embodiment a video gaming device and includes a cabinet 12 having at least one video monitor. The illustrated embodiment includes two video monitors 14 and 16. Cabinet 12 is illustrated as being of a type where the player stands or sits. The cabinet is alternatively a bar top cabinet, wherein the player sits to play the Keno game of the present invention.

The cabinet 12 also provides controls for a player to operate gaming device 10. In the illustrated embodiment, various electromechanical input devices 18 are provided on a tilted portion 20 of the cabinet 12, below video monitors 14 and 16. Electromechanical input devices 18 each send a discrete signal to a microprocessor located within cabinet 12. These input devices enable the player to perform the various Keno functions, including but not limited to, selecting at least one of the Keno numbers, playing "ways" or multiple games at once, wagering a number of credits per game or "way" and cashing out. The input devices 18 also enable the player to play multiple Keno games in a row, analogous to the 'multi run' or 'stray and play' Keno tickets offered by the casino.

Similar to the electromechanical input devices 18, cabinet 12 of gaming device 10 can provide electromechanical displays that show, for example, the player's credits maintained within gaming device 10, the number of Keno numbers played, the bet per game, etc. In one preferred embodiment, however, these functions as well as others are provided on one or more video monitor or display devices 14 and 16. In the illustrated embodiment, display device 14 shows the pays for a number of hits or matches between the numbers that the player selects and the numbers that gaming device 10 generates. Displays 14 and 16 can also inform the player of the rules concerning the operation of and the generation of free games while playing the Keno game of the present invention.

Video monitor 16 displays, among other items: (i) the Keno numbers randomly generated by gaming device 10; (ii) the numbers played by the player; (iii) the number of 'ways' or simultaneous games played by the player, and the numbers selected by the player for each 'way', (iv) the wager per game; (v) the player's total wager; (vi) one or more free game generations; and (vii) whether the player wins a Keno award or one and/or one or more free games. In one embodiment, when the player selects a number, gaming device 10 highlights it as a certain color, for example, yellow. When the gaming device generates a number, gaming device 10 highlights it as a different color, for example, blue. When a match occurs, the number is highlighted by a third color, for example, green, a combination of blue and yellow.

Cabinet 12 of gaming device 10 also includes one or more monetary input devices 22. The monetary input device 22 can accept coins, cash, a smart card, a credit card, a debit card, a casino card or other type of gaming device card. Keno gaming device 10 can also include a ticket reader and a ticket printer (not illustrated) that enables the player to input and receive a redeemable ticket in lieu of cash. The ticket reader/validator and printer operate with a processor housed inside gaming device 10.

Figure 2:
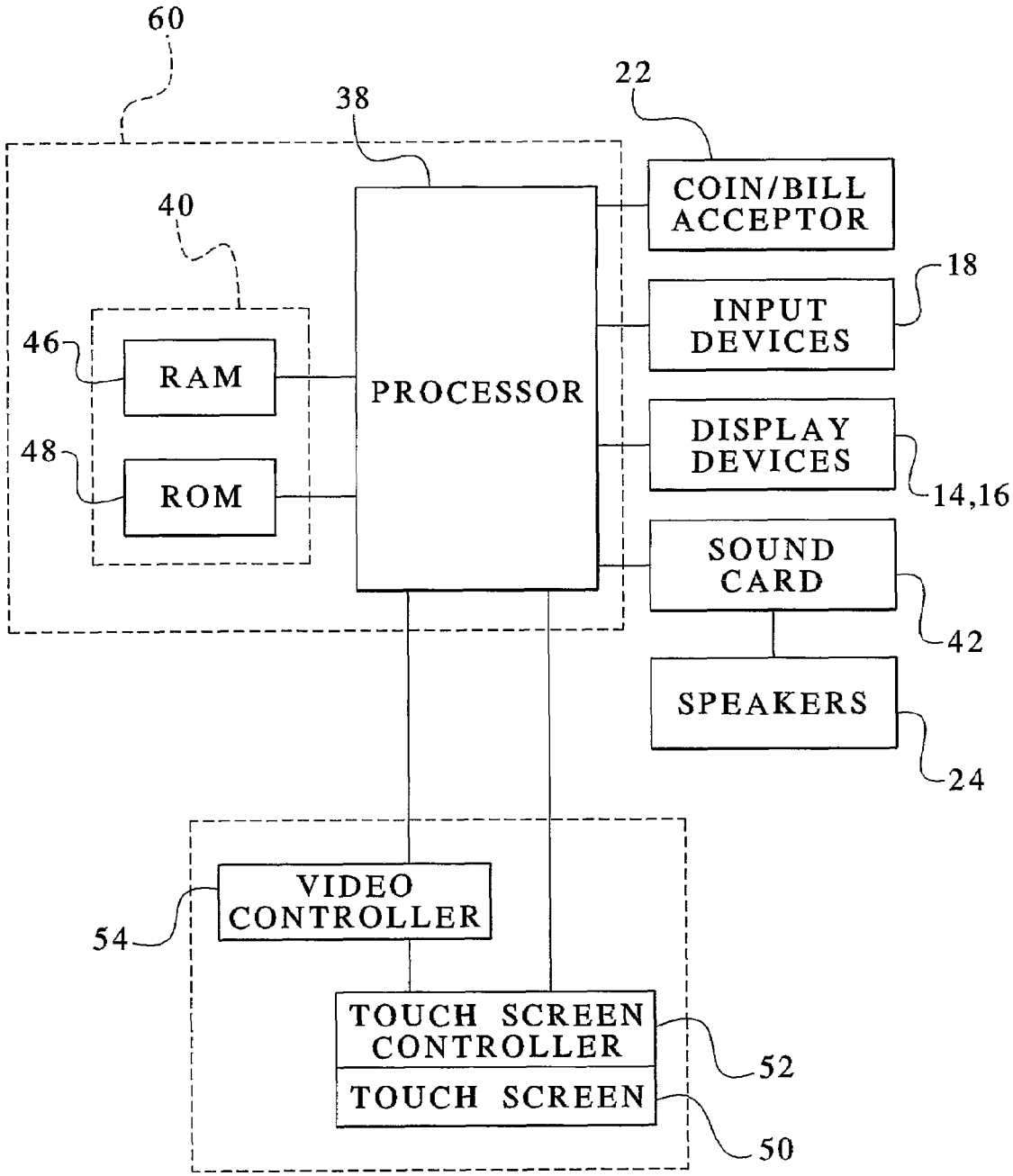
FIG. 2 is an electrical schematic for one embodiment of a gaming device having the Keno game of the present invention.

Referring now to FIG. 2, gaming device 10 is run by a processor or central processing unit ("CPU") 38 and a memory device 40 that operates with one or more display devices 14 and 16 that display the generated Keno numbers. Processor 38 can be a microprocessor and have a microcontroller-based platform. The memory device 40 includes random access memory ("RAM") 46 and read only memory ("ROM") 48. The platform for the processor 38 and memory device 40 can be: (i) inside gaming device 10; or (ii) as stand alone components in the casino, part of a server/client system, data network, one or more application-specific integrated circuits (ASIC's) or one or more hard-wired devices.

Gaming device 10 can house its own gaming program or be linked in a client/server manner via a data network 60, wherein the present invention provides some or all of the functions of the processor and memory device at a central location, such as a network server for communication to a playing station over a local area network (LAN), wide area network (WAN), Internet connection, microwave link and the like.

The gaming device 10 or casino can include a Keno goose that generates the Keno numbers or any other type of theme based lottery display. Cabinet 12 of gaming device 10 also provides a number of speakers 24 that operate via a soundcard 42 with processor 38 to inform the player of any type of output, outcome or instruction of gaming device 10.

Gaming device 10 provides an electromechanical input device 18 or simulated input device provided by a touch screen 50 that operates via a touch screen controller 52 and a video controller 54 with the processor 38. The input devices enable the player to operate the Keno gaming device 10 of the present invention. One of the video monitors 14 and 16 and possibly, additionally the speakers 24 are used to explain: (i) when the free game generation occurs, e.g., upon the last Keno number generation or randomly with the Keno number generations; (ii) how many matches are required to win a free game, e.g., one; (iii) how many free games are provided, e.g., one upon the attainment of the required number of matches; and (iv) the type of award provided for obtaining the required number of matches.

Gaming device 10 in one embodiment operates the Keno game of the present invention as well as another game, such as slot, poker, blackjack, craps or other video wagering game. In one embodiment, the Keno game is displayed on one video monitor 14, while the second game is displayed on the video monitor 16 or vice versa. Besides providing free Keno games, the present invention, in any of the embodiments described herein, can provide a free slot, poker, blackjack, craps game, bingo, etc., or other awards such as a free casino beverage or meal. Further, the free game or free outcome can include a series or set of games, at least one of the games being a Keno game and at least one other game being one of the games listed above.

The Keno game of the present invention, whether provided in gaming device 10 or as a casino game, can include any suitable variation of Keno. For purposes of the present invention, the game is illustrated in combination with the variation sometimes referred to as 'horse race' or Nevada Keno. In this Keno game, one or more players play against the house. A typical Keno card includes eighty different numbers from which the player chooses. The player circles or marks a combination of numbers. The player decides which numbers to choose and how many numbers to choose, usually anywhere from one to fifteen numbers in casino play and one to ten numbers for play on gaming device 10.

In the casino version, the player brings a marked card to a Keno clerk. The clerk records the player's numbers and issues a receipt to the player. The player finds a Keno monitor and watches the numbers being posted as they are chosen. As the player watches the generation of the Keno numbers, the player marks the generated numbers on the card. For an eighty number game of Keno, twenty numbers are typically generated.

Figure 3:
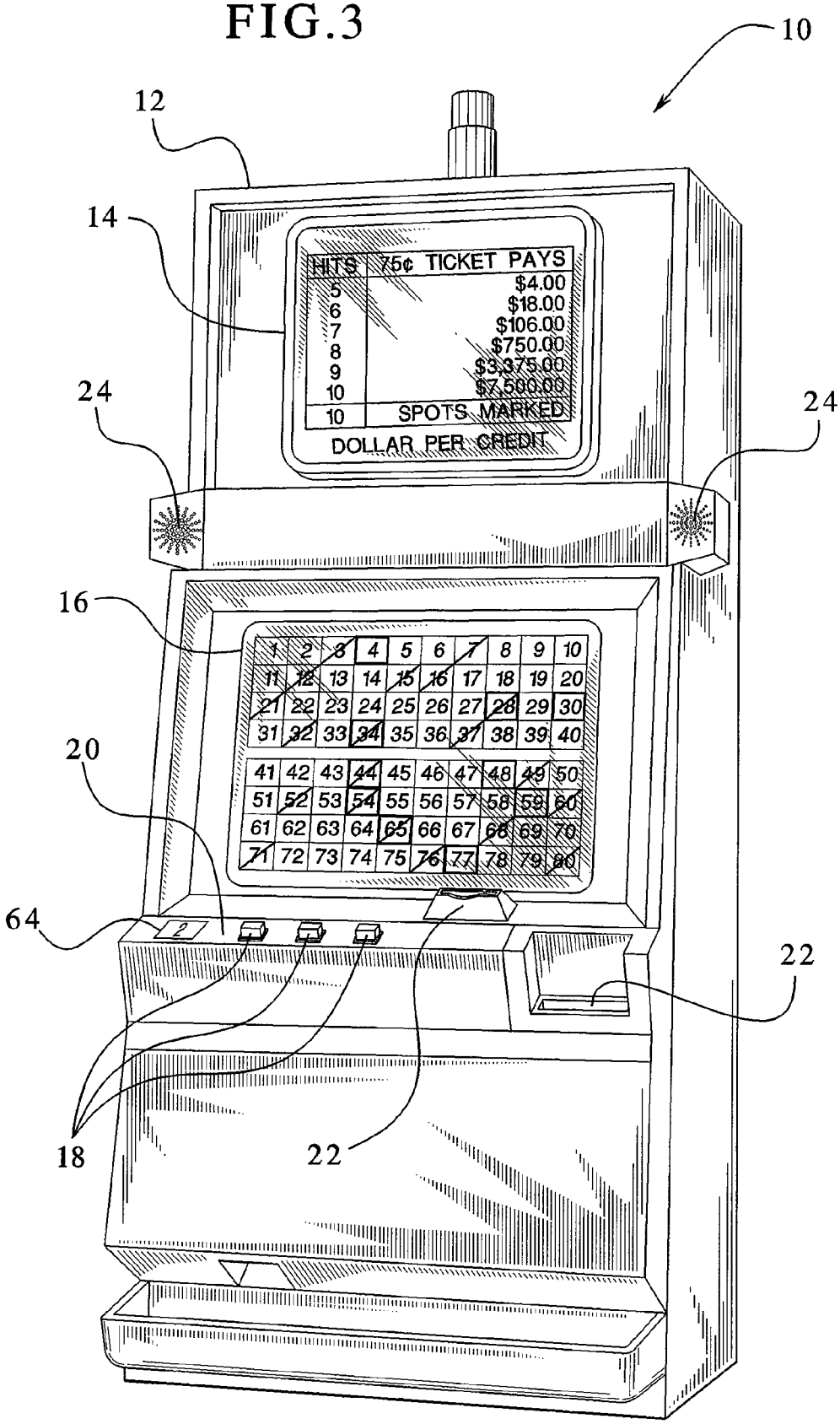
FIG. 3 is a perspective view of a gaming device incorporating the Keno game of the present invention shown with player selected and game generated numbers.

As illustrated by FIG. 3, the player presses one of the electromechanical pushbuttons 18 or touches the touch screen 50 that operates with display device 16 to select the ten numbers (bolded and bordered) 4, 28, 30, 34, 44, 48, 54, 59, 65 and 77. Gaming device 10 randomly selects twenty numbers (slashed-through) 3, 7, 12, 15, 16, 21, 28, 32, 34, 37, 44, 49, 52, 54, 60, 65, 68, 71, 76 and 80. There are four matches shown, namely, 28, 34, 44, 54 and 65 (bearing both markings). According to the paytable displayed in display device 14, gaming device 10 pays $4.00 on a one dollar bet for five matches (assuming player picks ten numbers).

With the video and casino embodiments, at the end of drawing twenty numbers, the amount of matched numbers determines: (i) whether or not player wins and (ii) how much the player wins. The greater percentage of the player's numbers that are randomly generated by gaming device 10 or the casino's number generator, the more the player wins. If the player has enough matches to claim a winning ticket, which depends on how many numbers the player has selected, the player can return to the Keno clerk to redeem the winning ticket.

Keno payouts vary from gaming device to gaming device and from casino to casino. For example, if the player picks five numbers, the game can require that the random generation device generate three of those five numbers for the player to receive any award. If the game generates three matches, the game usually pays the player back at three to one. However, certain gaming devices or casinos could pay back at 2.5 or 3.5 to one. If the game generates four matches for the same player pick of five numbers, the game typically pays the player back at around twenty-six to one. If the game generates all five matches, the game pays the player back at around 332 to 1.

In addition to the standard payouts, the present invention enables the player to win one or more free Keno games. The game designates one or more of the random generations as a free game generation. In addition to contributing to the possible matches, the free game generation also provides one or more free games to the player if the particular random generation results in a match, i.e., randomly selects one of the numbers the player has picked.

The free game generation in one embodiment is the final generation or last player picked number. In eighty number 'horse race' Keno, the final generation is usually the twentieth generation. The twentieth generation can also provide a win for the player or increase the player's win depending upon how many prior matches have occurred and how many numbers the player has played. In one embodiment, the free game generation provides a single free Keno game to the player if the generation results in a match. The player does not have to win a standard Keno award to receive the free game in one embodiment. That is, the twentieth generation could result in just the first match and still yield a free game to the player. Alternatively, the game does require the player to win a standard Keno amount to be eligible to win a free game.

Figure 4:
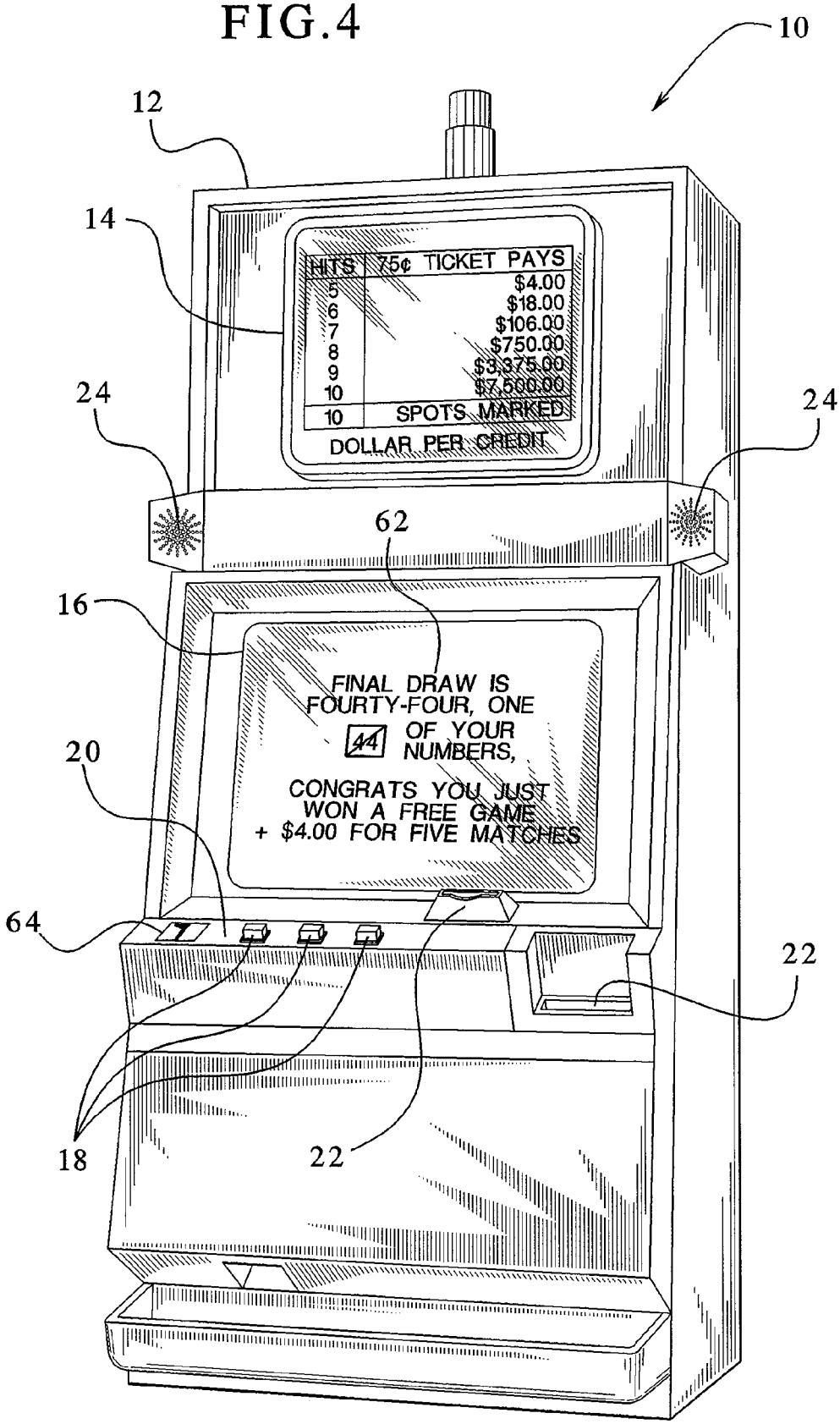
FIG. 4 is a perspective view of a gaming device incorporating the Keno game of the present invention shown providing the player with a free game.

Referring now to FIG. 4, using the gaming device example above, if the last number generated by gaming device 10 is forty-four as illustrated, which is also a number selected by the player, gaming device 10 displays an audio, visual or audiovisual message 62 that informs the player that the player has just won a free game. Gaming device 10 can also inform the player (not illustrated) just prior to the message 62 that the game is currently performing or about to perform a free game generation. For example, gaming device 10 can provide an audio, visual or audiovisual message stating, "the next number drawn will win you a free game if it's one of the numbers you've selected."

FIGS. 1, 3 and 4 also illustrate a credit meter 64, which shows how many credits the player currently has in the game, which corresponds to how much money the player has inserted into gaming device 10, less the number of games played plus any credits generated during game play. In FIG. 1, the player has three credits. The game costs one dollar to play as illustrated by FIG. 3, wherein credit meter 64 has decreased to two credits or games remaining. FIG. 4 illustrates that gaming device 10 has paid the player four credits for winning the payout of the Keno game of gaming device 10 as well as a free game for having a match occur during the free game generation. Five credits are added to the player's total, which is seven. It is also possible, although not illustrated, to provide a separate meter showing only the amount of free games awarded as opposed to the overall amount of games for which the player has credits.

In one alternative embodiment, a single free game generation or triggering event yields a multitude of free Keno games upon one or more matches in accordance with the game mathematics. In another alternative embodiment, the free game generation occurs before the final generation, e.g., the first generation or one of the middle generations. Still further, the free game generation occurs at multiple predetermined times during the total number of generations. The multiple free game generations can vary depending on how many numbers the player plays. In each of these embodiments, each free game generation can yield one or a multitude of free Keno games upon one or more matches in accordance with the game mathematics.

In still a further alternative embodiment, the free game generation occurs randomly, one or more times, during the total number of generations. The free game generation can occur during some games but not others. The multiple free game generations can vary depending on how many numbers the player plays. In each of these embodiments, each free game generation can provide one or a multitude of free Keno games in accordance with the game mathematics.

The free game generation can alternatively depend on the amount of the player's wager. For example, if the player wagers a first amount, the player is enabled to win a first amount or an amount from a first range of free games. If the player wagers a second amount, the player is enabled to win a second amount or an amount from a second range of free games.

In yet another alternative embodiment, the free game generation occurs multiple times, either at predetermined or random times, wherein multiple matches must occur for the player to receive one or more free games. The game can require two matches out of two chances, three chances, etc., or any other percentage desired by the game implementor. The multiple chances can vary depending on how many numbers the player plays. The multiple free game generation can occur during some games but not others. Each free game generation can provide one or a multitude of free Keno games in accordance with the game mathematics. Alternatively, the free game generations can provide other types of free games to the player, such as a number of tokens to be used with slot, video poker, video blackjack, etc. The free game generators can also provide other types of benefits to the player, such as a free beverage, meal, etc.

In one embodiment, the free game automatically uses the same amount of numbers chosen by the player. For example, if the player chooses seven numbers and wins a free game, the free game is automatically played with the same seven numbers. In another embodiment, the player is able to change numbers and/or the amount of numbers played. In a further embodiment, the free game is played with an amount of numbers predetermined or randomly chosen by the house.

By way of example and not limitation, fifteen tables are shown below according to one embodiment of the present invention, wherein the Keno game provides one free game generation (e.g., the last or twentieth generation) and requires the generation to result in a match for the player to receive a free game. The tables show the amount of numbers selected by the player. For each amount, the tables show: (i) the probability of winning one or more free games according to the present invention; (ii) the probability that the random generation device generates a given number of matches to the numbers selected by the player; (iii) a typical payoff table for each number of matches; (iv) the contribution of a particular number of matches toward a total expected return; and (v) and the total expected return for all possible numbers of matches.

The tables illustrate that the probabilities vary depending on the amount of numbers the player chooses. For any given amount of numbers, there is a probability distribution for each possible number of matches. For example, if the player picks four numbers, the player has a 31% chance receiving no matches, a 21% chance of receiving two matches and a 0.3% chance that all numbers chosen by the player are generated within twenty random generations by the game. Four matches pays one hundred thirty times the player's bet.

If the player plays for higher stakes and plays, e.g., fourteen numbers, the player has a two percent chance of seven matches, 0.4 percent chance of eight matches and one chance in 389 million that all fourteen numbers are matched. Four matches pays one hundred thousand times the player's bet.

The total return or expected value for each different wager is roughly the same, between about 0.71 and 0.75, which means that the game is designed to pay back seventy-one to seventy-five cents of every dollar wagered by the player. According to the expected values, it makes no or little difference to the casino whether the player picks one number or fifteen numbers. As illustrated by the free game match probabilities, however, the probabilities increase as the player plays more numbers. In another embodiment, the game evens out the free game match probabilities by requiring a higher percentage of matches as the player plays more numbers.

In one embodiment, the free game generation applies only to a certain amount or certain amounts of numbers picked by a player. For example, the Keno game can implement the free game generation only when the player picks seven numbers. According to the tables below, the player when playing seven numbers needs at least four matches for a payout, wherein the last generation is a free game generation.

TABLE 1

Pick 1
Free Game Match Probability for One Generation - .012

| Matches | Pays | Probability | Return |
|---|---|---|---|
| 0 | 0 | 0.75 | 0.00 |
| 1 | 3 | 0.25 | 0.75 |
| Total | | 1.00 | 0.75 |

TABLE 2

Pick 2
Free Game Match Probability for One Generation - .025

| Matches | Pays | Probability | Return |
|---|---|---|---|
| 0 | 0 | 0.56 | 0.00 |
| 1 | 0 | 0.38 | 0.00 |
| 2 | 12 | 0.06 | 0.72 |
| Total | | 1.00 | 0.72 |

TABLE 3

Pick 3
Free Game Match Probability for One Generation - .038

| Matches | Pays | Probability | Return |
|---|---|---|---|
| 0 | 0 | 0.42 | 0.00 |
| 1 | 0 | 0.43 | 0.00 |
| 2 | 1 | 0.14 | 0.14 |
| 3 | 43 | 0.0133 | 0.57 |
| Total | | 1.00 | 0.74 |

TABLE 4

Pick 4
Free Game Match Probability for One Generation - .05

| Matches | Pays | Probability | Return |
|---|---|---|---|
| 0 | 0 | 0.31 | 0.00 |
| 1 | 0 | 0.43 | 0.00 |
| 2 | 1 | 0.21 | 0.21 |
| 3 | 3 | 0.04 | 0.13 |
| 4 | 130 | 0.003 | 0.40 |
| Total | | 1.00 | 0.74 |

TABLE 5

Pick 5
Free Game Match Probability for One Generation - .063

| Matches | Pays | Probability | Return |
|---|---|---|---|
| 0 | 0 | 0.23 | 0.00 |
| 1 | 0 | 0.41 | 0.00 |
| 2 | 0 | 0.27 | 0.00 |
| 3 | 1 | 0.08 | 0.08 |
| 4 | 10 | 0.01 | 0.12 |
| 5 | 800 | 0.0006 | 0.52 |
| Total | | 1.00 | 0.72 |

TABLE 6

Pick 6
Free Game Match Probability for One Generation - .075

| Matches | Pays | Probability | Return |
|---|---|---|---|
| 0 | 0 | 0.17 | 0.00 |
| 1 | 0 | 0.36 | 0.00 |
| 2 | 0 | 0.31 | 0.00 |
| 3 | 1 | 0.13 | 0.13 |
| 4 | 4 | 0.03 | 0.11 |
| 5 | 95 | 0.003 | 0.29 |
| 6 | 1500 | 0.0001 | 0.19 |
| Total | | 1.00 | 0.73 |

TABLE 7

Pick 7
Free Game Match Probability for One Generation - .088

| Matches | Pays | Probability | Return |
|---|---|---|---|
| 0 | 0 | 0.12 | 0.00 |
| 1 | 0 | 0.32 | 0.00 |
| 2 | 0 | 0.37 | 0.00 |
| 3 | 0 | 0.17 | 0.00 |
| 4 | 1 | 0.05 | 0.05 |
| 5 | 25 | 0.009 | 0.22 |
| 6 | 350 | 0.0007 | 0.26 |
| 7 | 8000 | 0.00002 | 0.20 |
| Total | | 1.00 | 0.72 |

TABLE 8

Pick 8
Free Game Match Probability for One Generation - .10

| Matches | Pays | Probability | Return |
|---|---|---|---|
| 0 | 0 | 0.09 | 0.00 |
| 1 | 0 | 0.27 | 0.00 |
| 2 | 0 | 0.33 | 0.00 |
| 3 | 0 | 0.21 | 0.00 |
| 4 | 0 | 0.08 | 0.00 |
| 5 | 9 | 0.02 | 0.16 |
| 6 | 90 | 0.002 | 0.21 |
| 7 | 1500 | 0.0002 | 0.24 |
| 8 | 25000 | 0.000004 | 0.11 |
| Total | | 1.00 | 0.73 |

TABLE 9

Pick 9
Free Game Match Probability for One Generation - .113

| Matches | Pays | Probability | Return |
|---|---|---|---|
| 0 | 0 | 0.06 | 0.00 |
| 1 | 0 | 0.22 | 0.00 |
| 2 | 0 | 0.32 | 0.00 |
| 3 | 0 | 0.25 | 0.00 |
| 4 | 0 | 0.11 | 0.00 |
| 5 | 4 | 0.03 | 0.13 |
| 6 | 50 | 0.005 | 0.29 |
| 7 | 280 | 0.0006 | 0.17 |
| 8 | 4000 | 0.00003 | 0.13 |
| 9 | 50000 | 0.0000007 | 0.04 |
| Total | | 1.00 | 0.75 |

TABLE 10

Pick 10
Free Game Match Probability for One Generation - .125

| Matches | Pays | Probability | Return |
|---|---|---|---|
| 0 | 0 | 0.05 | 0.00 |
| 1 | 0 | 0.18 | 0.00 |
| 2 | 0 | 0.30 | 0.00 |
| 3 | 0 | 0.27 | 0.00 |
| 4 | 0 | 0.15 | 0.00 |
| 5 | 1 | 0.05 | 0.05 |
| 6 | 22 | 0.01 | 0.25 |
| 7 | 150 | 0.002 | 0.24 |
| 8 | 1000 | 0.0001 | 0.14 |
| 9 | 5000 | 0.000006 | 0.03 |
| 10 | 100000 | 0.0000001 | 0.01 |
| Total | | 1.00 | 0.72 |

TABLE 11

Pick 11
Free Game Match Probability for One Generation - .138

| Matches | Pays | Probability | Return |
|---|---|---|---|
| 0 | 0 | 0.03 | 0.00 |
| 1 | 0 | 0.14 | 0.00 |
| 2 | 0 | 0.27 | 0.00 |
| 3 | 0 | 0.28 | 0.00 |
| 4 | 0 | 0.18 | 0.00 |
| 5 | 0 | 0.07 | 0.00 |
| 6 | 8 | 0.02 | 0.16 |
| 7 | 80 | 0.004 | 0.29 |
| 8 | 400 | 0.0004 | 0.16 |
| 9 | 2500 | 0.00003 | 0.07 |
| 10 | 25000 | 0.000001 | 0.03 |
| 11 | 100000 | 0.00000002 | 0.001 |
| Total | | 1.00 | 0.72 |

TABLE 12

Pick 12
Free Game Match Probability for One Generation - .15

| Matches | Pays | Probability | Return |
|---|---|---|---|
| 0 | 0 | 0.02 | 0.00 |
| 1 | 0 | 0.11 | 0.00 |
| 2 | 0 | 0.24 | 0.00 |
| 3 | 0 | 0.28 | 0.00 |
| 4 | 0 | 0.21 | 0.00 |
| 5 | 0 | 0.10 | 0.00 |
| 6 | 5 | 0.03 | 0.16 |
| 7 | 32 | 0.007 | 0.22 |
| 8 | 200 | 0.001 | 0.20 |
| 9 | 1000 | 0.000095 | 0.10 |
| 10 | 5000 | 0.000005 | 0.03 |
| 11 | 25000 | 0.0000002 | 0.004 |
| 12 | 100000 | 0.000000002 | 0.0002 |
| Total | | 1.00 | 0.72 |

TABLE 13

Pick 13
Free Game Match Probability for One Generation - .163

| Matches | Pays | Probability | Return |
|---|---|---|---|
| 0 | 1 | 0.02 | 0.02 |
| 1 | 0 | 0.09 | 0.00 |
| 2 | 0 | 0.21 | 0.00 |
| 3 | 0 | 0.27 | 0.00 |
| 4 | 0 | 0.23 | 0.00 |
| 5 | 0 | 0.13 | 0.00 |
| 6 | 1 | 0.05 | 0.05 |
| 7 | 20 | 0.01 | 0.25 |
| 8 | 80 | 0.002 | 0.17 |
| 9 | 600 | 0.0003 | 0.16 |
| 10 | 3500 | 0.00002 | 0.07 |
| 11 | 10000 | 0.0000009 | 0.009 |
| 12 | 50000 | 0.00000002 | 0.001 |
| 13 | 100000 | 0.0000000002 | 0.00002 |
| Total | | 1.00 | 0.72 |

TABLE 14

Pick 14
Free Game Match Probability for One Generation - .175

| Matches | Pays | Probability | Return |
|---|---|---|---|
| 0 | 1 | 0.01 | 0.01 |
| 1 | 0 | 0.07 | 0.00 |
| 2 | 0 | 0.18 | 0.00 |
| 3 | 0 | 0.26 | 0.00 |
| 4 | 0 | 0.24 | 0.00 |
| 5 | 0 | 0.15 | 0.00 |
| 6 | 1 | 0.07 | 0.07 |
| 7 | 9 | 0.02 | 0.18 |
| 8 | 42 | 0.004 | 0.18 |
| 9 | 310 | 0.0006 | 0.19 |
| 10 | 1100 | 0.00006 | 0.07 |
| 11 | 8000 | 0.000004 | 0.03 |
| 12 | 25000 | 0.0000001 | 0.004 |
| 13 | 50000 | 0.000000003 | 0.0002 |
| 14 | 100000 | 0.00000000003 | 0.000003 |
| Total | | 1.00 | 0.72 |

TABLE 15

Pick 15
Free Game Match Probability for One Generation - .188

| Matches | Pays | Probability | Return |
|---|---|---|---|
| 0 | 1 | 0.008 | 0.008 |
| 1 | 0 | 0.05 | 0.00 |
| 2 | 0 | 0.15 | 0.00 |
| 3 | 0 | 0.24 | 0.00 |
| 4 | 0 | 0.25 | 0.00 |
| 5 | 0 | 0.18 | 0.00 |
| 6 | 0 | 0.09 | 0.00 |
| 7 | 10 | 0.03 | 0.30 |
| 8 | 25 | 0.007 | 0.18 |
| 9 | 100 | 0.001 | 0.13 |
| 10 | 300 | 0.0002 | 0.05 |
| 11 | 2800 | 0.00001 | 0.03 |
| 12 | 25000 | 0.0000006 | 0.02 |
| 13 | 50000 | 0.00000002 | 0.001 |
| 14 | 100000 | 0.0000000004 | 0.00004 |
| 15 | 100000 | 0.000000000002 | 0.0000002 |
| Total | | 1.00 | 0.71 |

The free game is played using the same paytables, such as tables one to fifteen shown above, as the tables used for the game that generates the free game. In an alternative embodiment, a different set, e.g., a higher paying set of tables, is used for the free game versus the game generating the free game. Similarly, the free game is played using the same odds of generating a winning outcome and/or a free game as the odds used for the game that generates the free game. In an alternative embodiment, different odds, e.g., higher odds, are used for the free game versus the game generating the free game. Playing a free games can generate one or more additional free games.

Figure 5:
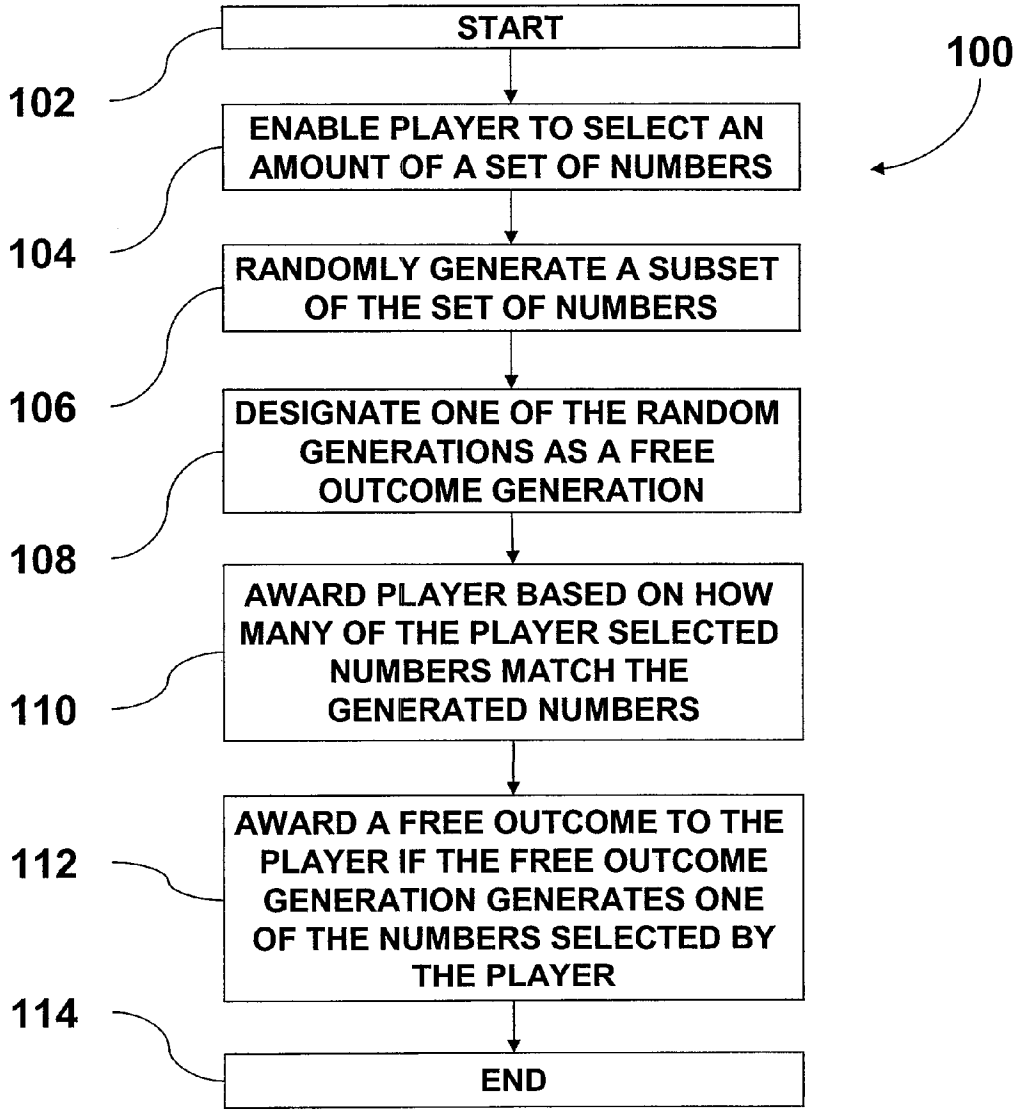
FIG. 5 is a process flow diagram showing one possible flow sequence of one embodiment of a method of operating a gaming device.

FIG. 5 illustrates a process flow diagram showing one possible flow sequence 100 of one embodiment of a method of operating a gaming device. The sequence 100 begins in block 102. The sequence 100 is provided via a gaming device or a data network, such as gaming device 10 or data network 60 described above. The gaming device enables a player to select an amount of a set of numbers as indicated in block 104. The player selects the amount of the set of numbers via an input device such as the electromechanical input device 18, the simulated input device provided by touch screen 50 or the ticket reader/validator and printer described above. The ticket printer provides the player with a ticket, which when read by the ticket reader/validator, enables the player to select the amount of the set of numbers. As indicated in block 106, the processor or another random generation device randomly generates a subset of the set of numbers. A display device, such as display device 14 and/or 16, displays each random generation. The processor or another random generation device designates at least one random generation as a free outcome generation as indicated in block 108. The gaming device awards the player based on how many of the player selected numbers match the generated numbers as indicated in block 110. The gaming device awards at least one free outcome to the player if the at least one free outcome generation generates one of the numbers selected by the player as indicated in block 112. The sequence 100 ends in block 114.

The present invention also incorporates 'multi race' Keno tickets, which can run for two to twenty (typically) consecutive games. The game in one embodiment plays any free game(s) directly after they occur. If the player has a twenty game 'multi race' ticket and wins a free game in the tenth game, the eleventh game is the free game and the twelfth game is the original eleventh game. In another embodiment, all free games are stored and played at the end of the 'multi race' Keno ticket.

Further, the present invention incorporates the 'stray and play' type Keno tickets, which applies to the next 'X' number of games (usually greater than 20), wherein the player does not have to return to the Keno station after twenty-five or thirty games. Here again, the game in one embodiment plays any free game(s) directly after they occur. In another embodiment, all free games are stored and played at the end of the 'stray and play' ticket.

The present invention also incorporates 'way' or combination bets. As described above, 'way' bets enable the player to play multiple games at one time. In the same manner as described above for a single game, including each of the various embodiments described for same, any one or more of the 'ways' of a 'way' bet can result in one or more free games for the player. Two single 'ways' can simultaneously, upon the same random generation, each produce one or more free games for the player. Two single 'ways' can at different times and upon different random generations, each produce one or more free games for the player.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A method of operating a gaming device including a plurality of instructions, the method comprising:

(a) causing at least one input device to, upon receiving an input of a wager by a player, enable the player to select a first amount of a plurality of different numbers;

(b) causing at least one processor to execute the plurality of instructions to randomly generate a second amount of the plurality of different numbers in at least one random generation;

(c) causing the at least one processor to execute the plurality of instructions to designate at least one of the generated numbers as a free game number;

(d) causing the at least one processor to execute the plurality of instructions to award the player based on how many of the player selected numbers match the generated numbers; and (e) causing at least one display device to display a free game if the designated free game number matches one of the numbers selected by the player.

2. The method of claim 1, wherein the plurality of different numbers includes numbers one to eighty and the second amount of the plurality of different numbers is twenty.

3. The method of claim 1, which includes causing the at least one input device to enable the player to select from one to ten of the plurality of different numbers for the first amount.

4. The method of claim 1, which includes causing the at least one processor to execute the plurality of instructions to use the first amount of the plurality of different numbers selected by the player in the free game.

5. The method of claim 1, which includes causing the at least one processor to execute the plurality of instructions to use a randomly generated set of the plurality of different numbers in the free game.

6. The method of claim 1, which includes causing the at least one processor to execute the plurality of instructions to: (i) randomly generate the second amount of the plurality of different numbers in a plurality of random generations, and (ii) designate the generated number that occurs upon a last one of the random number generations as the free game number.

7. The method of claim 1, which includes causing the at least one processor to execute the plurality of instructions to randomly designate one of the generated numbers as the free game number.

8. The method of claim 1, which includes causing the at least one display device to display a plurality of free games if the free game number matches one of the numbers selected by the player.

9. The method of claim 1, which includes causing the at least one processor to execute the plurality of instructions to designate a plurality of the generated numbers as free game numbers, and causing the at least one display device to display the free game if at least a portion of the plurality of the free game numbers match numbers selected by the player.

10. The method of claim 1, which includes causing the at least one processor to execute the plurality of instructions to designate a plurality of the generated numbers as free game numbers, and causing the at least one display device to display the free game if the free game numbers match a portion of the numbers selected by the player, the portion based on the first amount of the plurality of different numbers selected by the player.

11. The method of claim 1, which includes causing the at least one processor to execute the plurality of instructions to base a frequency of occurrence of a free game number on the player's wager.

12. The method of claim 1, which includes causing the at least one processor to execute the plurality of instructions to base a frequency of occurrence of the free game on the player's wager.

13. The method of claim 1, wherein the free game number is a first free game number and the at least one processor executes the plurality of instructions to provide a second free game number as an outcome of at least one play of the free game.

14. The method of claim 1, which is provided via a data network.

15. The method of claim 14, wherein the data network is an internet.

16. A method of operating a gaming device including a Keno game and a plurality of instructions, the method comprising:

(a) causing at least one input device to enable a player to make an input of a wager;

(b) after the input of the wager by the player, causing at least one display device to display a plurality of different numbers;

(c) causing the at least one input device to enable the player to select a first amount of the plurality of different numbers;

(d) causing at least one processor to execute the plurality of instructions to randomly generate a second amount of the plurality of different numbers in at least one random generation;

(e) causing the at least one processor to execute the plurality of instructions to designate at least one of the generated numbers as a free game number;

(f) causing the at least one processor to execute the plurality of instructions to award the player based on how many of the player selected numbers match the generated numbers; and (g) causing the at least one display device to display a free game if the designated free game number matches one of the numbers selected by the player.

17. The method of claim 16, wherein the plurality of different numbers includes numbers one to eighty and wherein the second amount of the plurality of different numbers is twenty.

18. The method of claim 16, which includes causing the at least one input device to enable the player to select from one to fifteen of the plurality of different numbers for the first amount.

19. The method of claim 16, which includes causing the at least one processor to execute the plurality of instructions to use the first amount of the plurality of different numbers selected by the player in the free game.

20. The method of claim 16, which includes causing the at least one processor to execute the plurality of instructions to use a randomly generated set of the plurality of different numbers in the free game.

21. The method of claim 16, which includes causing the at least one processor to execute the plurality of instructions to: (i) randomly generate the second amount of the plurality of different numbers in a plurality of random number generations, and (ii) designate a last one of the random number generations as the free game number.

22. The method of claim 16, which includes causing the at least one processor to execute the plurality of instructions to randomly designate one of the generated numbers as the free game number.

23. The method of claim 16, which includes causing the at least one display device to display a plurality of free games if the free game number matches one of the numbers selected by the player.

24. The method of claim 16, which includes causing the at least one processor to execute the plurality of instructions to designate a plurality of the generated numbers as free game numbers, and causing the at least one display device to display the free game if at least a portion of the plurality of the free game numbers match numbers selected by the player.

25. The method of claim 16, which includes causing the at least one processor to execute the plurality of instructions to designate a plurality of the generated numbers as free game numbers, and causing the at least one display device to display the free game if the free game numbers match a portion of the numbers selected by the player, the portion based on the first amount of the plurality of different numbers selected by the player.

26. The method of claim 16, which includes causing the at least one processor to execute the plurality of instructions to base a frequency of occurrence of the free game on the player's wager.

27. The method of claim 16, which includes causing the at least one processor to execute the plurality of instructions to base a frequency of occurrence of a free game number on the player's wager.

28. The method of claim 16, wherein the free game number is a first free game number and the at least one processor executes the plurality of instructions to provide a second free game number as an outcome of at least one play of the free game.

29. The method of claim 16, wherein the free game includes a set of games, at least one of the games being a Keno game and at least one other game selected from the group consisting of: slot, poker, blackjack, craps and bingo.

30. The method of claim 16, which is provided via a data network.

31. The method of claim 30, wherein the data network is an internet.

32. A computer readable medium comprising:

a plurality of instructions, which when executed by at least one processor of a gaming system, cause the gaming system to:

(i) enable a player to select a first amount of a plurality of different numbers;

(ii) randomly generate a second amount of the plurality of different numbers in at least one random generation;

(iii) designate at least one of the generated numbers as a free game number;

(iv) display an award, the award based on how many of the player selected numbers match the generated numbers; and (v) display a free game if the designated free game number matches one of the numbers selected by the player.

33. A computer readable medium comprising:

a plurality of instructions, which when executed by at least one processor of a gaming system, cause the gaming system to:

(i) display a plurality of different numbers;

(ii) enable a player to select a first amount of the plurality of different numbers;

(iii) randomly generate a second amount of the plurality of different numbers in at least one random generation;

(iv) designate at least one of the generated numbers as a free game number;

(v) display an award, the award based on how many of the player selected numbers match the generated numbers; and (vi) display a free game if the designated free game number matches one of the numbers selected by the player.

* * * * *